United States Patent [19]

Reist

[11] Patent Number: 4,666,143

[45] Date of Patent: May 19, 1987

[54] APPARATUS FOR STACKING FLAT PRODUCTS, ESPECIALLY PRINTED PRODUCTS ARRIVING IN AN IMBRICATED STREAM

[75] Inventor: Walter Reist, Hinwil, Switzerland

[73] Assignee: Ferag AG, Hinwil, Switzerland

[21] Appl. No.: 703,215

[22] Filed: Feb. 19, 1985

Related U.S. Application Data

[63] Continuation-in-part of Ser. No. 377,325, May 12, 1982, abandoned.

[30] Foreign Application Priority Data

Sep. 16, 1980 [CH] Switzerland ..... 6923/80
Sep. 14, 1981 [WO] PCT Int'l Appl. ....PCT/CH81/00103

[51] Int. Cl.[4] ..... B65H 29/04
[52] U.S. Cl. ..... 271/204; 271/216; 271/300
[58] Field of Search ..... 271/198, 204, 205, 206, 271/216, 300

[56] References Cited

U.S. PATENT DOCUMENTS

| | | | |
|---|---|---|---|
| 2,355,697 | 8/1944 | Belluche | 271/204 |
| 3,391,928 | 7/1968 | Mowry et al. | 271/204 |
| 4,445,681 | 5/1984 | Reist | 271/204 |
| 4,498,664 | 2/1985 | Reist | 271/204 |

FOREIGN PATENT DOCUMENTS

| | | | |
|---|---|---|---|
| 921064 | 3/1963 | United Kingdom | 271/300 |

*Primary Examiner*—Andres Kashnikow
*Assistant Examiner*—Matthew C. Graham
*Attorney, Agent, or Firm*—Werner W. Kleeman

[57] ABSTRACT

By means of a conveyor device, which possesses grippers arranged behind one another in the product conveying direction, the printed products are infed in an imbricated formation to at least one but possibly two or more stacker units. These stacker units are successively arranged in the product conveying direction below the conveyor device. Above each stacker unit there is located a release device for the grippers. In each case at least one of the release devices is located in its switched-on condition for opening the grippers moving therepast. The printed products are drawn by the conveyor device over the stacker compartment of the stacker units. The products released above the intended stacker compartment, upon opening of the grippers, drop essentially in vertical direction downwardly and after a short free-fall path arrive in such stacker compartment. While there is accomplished in the one stacker unit a stacking of the printed products there are not infed any printed products to the other stacker unit during such time that its stacker compartment is emptied. Thereafter to the extent necessary the one prior switched-on release device is switched-off and to the extent necessary the other release device is switched-on, so that now the arriving printed products can be stacked in the other stacker unit.

5 Claims, 1 Drawing Figure

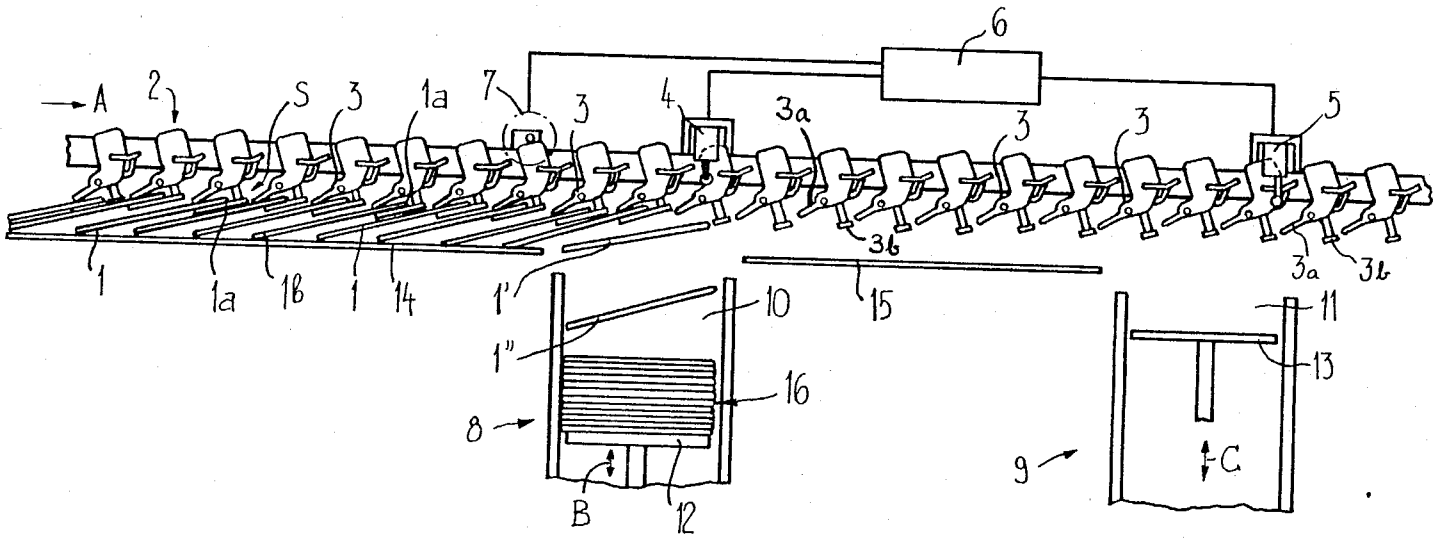
A
2
S
3
1a
7
4
3
3a
3b
6
5
3
3a
3b
1
1b
1a
14
1'
1''
8
B
12
16
10
15
9
C
13
11

APPARATUS FOR STACKING FLAT PRODUCTS, ESPECIALLY PRINTED PRODUCTS ARRIVING IN AN IMBRICATED STREAM

CROSS REFERENCE TO RELATED APPLICATIONS

This application is related to my commonly assigned, copending U.S. application Ser. No. 297,216, filed Aug. 28, 1981, entitled: "Apparatus for Removing from a Product Stream Conveyed by Means of a Conveyor Device Flat Products, Especially Printed Products", now U.S. Pat. No. 4,445,681, granted May 1, 1984, and my commonly assigned, copending U.S. application Ser. No. 360,212, filed Mar. 22, 1982, entitled: "Apparatus for Removing from a Product Stream Conveyed by Means of a Conveyor Device Flexible, Flat Products, Especially Printed Products", now U.S. Pat. No. 4,498,664, granted Feb. 12, 1985. This application is also a continuation-in-part of my commonly assigned, copending U.S. application Ser. No. 377,325, filed May 12, 1982, and entitled "Apparatus For Stacking Flat Products, Especially Printed Products Arriving In An Imbricated Formation", now abandoned.

BACKGROUND OF THE INVENTION

The present invention relates to a new and improved apparatus for stacking flat products arriving in an imbricated stream, preferably printed products which constitute relatively stiff products.

In its more particular aspects, the present invention relates specifically to a new and improved apparatus for stacking products arriving in an imbricated stream, preferably printed products, which contains at least one stacker device possessing at least one periodically emptiable stacker compartment for forming stacks. An infeed device infeeds the products to the stacker compartment and an infeeder is arranged forwardly of the infeed device for the infeed of the products to the infeed device.

With such type of stacking apparatus known from German Patent Publication No. 2,752,513 (and the corresponding British Pat. No. 1,568,752, published June 4, 1980) the infeeder is constituted by a transport device containing grippers arranged behind one another in its conveying direction, which grippers individually seize the printed products and then upon release thereof free such products. In the conveying direction of this infeeder there are arranged at a spacing behind one another two stacker units which are alternatingly loaded with printed products. Leading to the stacker chute of each stacker unit is a conveyor band arranged below the infeeder and laterally of the stacker unit, this conveyor band terminating shortly before the stacker chute. Viewed in the conveying direction of the infeeder there is arranged at a spacing behind each stacker unit a release device which can be switched-on and switched-off, and which in the switched-on condition opens the grippers moving therepast. The printed products released by the grippers are taken-over by the related conveyor band and transported towards the stacker chute. Due to an alternate switching-on and switching-off of the release devices there is either loaded the one or the other stacker unit.

The printed products which are infed by the infeeder in an imbricated formation to the conveyor bands are again deposited in an imbricated formation upon the conveyor bands. Consequently, the printed products are moved by the conveyor bands likewise in an imbricated stream towards the stacker chutes and so-to-speak pushed into the same. After release by the conveyor band the printed products drop into the stacker chute. The point in time of such release cannot, however, be exactly determined and also not readily influenced. Therefore, it is possible that the products will not drop into the stacker chute during uniform time intervals, which, under circumstances, can have a disadvantageous effect upon the quality of the product stack.

The products which are, as mentioned, propelled by the conveyor bands into the related stacker chute, are moved with their leading edge against a wall of the stacker chute, by means of which they are then stopped in their movement imparted by the conveyor band. This impact of the products against the stacker chute wall can lead to damage of the products. The previously explained principle of pushing the products into the stacker chute in an imbricated formation likewise is used by the most general other known stacker devices.

SUMMARY OF THE INVENTION

Therefore, with the foregoing in mind it is a primary object of the present invention to provide a new and improved apparatus for stacking flat relatively stiff products, preferably printed products, arriving in an imbricated stream of flat products, which apparatus, while possessing an extremely simple construction, renders possible a faultless and protective stacking of the products.

In contrast to the previously discussed prior art solution, the products are not conveyed by means of a conveyor band from the side to the stacker compartment, rather they are moved by means of a conveyor device over the stacker compartment and which conveyor device individually seizes the products and also individually releases the same. By means of the action of a control device or control the products infed in the imbricated formation are released from the conveyor device as soon as they are located above the stacker compartment into which they then subsequently drop. The products conveyed to the stacker device are thus released above the stacker compartment from the imbricated formation and then individually move and in a propelled free-fall through a short path up to the stacker compartment. Consequently, the inventive apparatus appreciably deviates from the heretofore proposed solution which, as already explained, resides in guiding the products in an imbricated formation up to the stacker compartment and subsequently pushing such into this stacker compartment.

By virtue of the controlled release of the products there is accomplished the infeed of these products into the stacker compartment essentially at uniform time intervals, which favors the formation of a faultless product stack.

To render possible a periodic emptying of the stacker compartment, without having to interrupt the product stream which is continuously infed by the conveyor device, it is proposed in accordance with a preferred embodiment to provide two stacker compartments which are alternately supplied with products. With a still further variant construction there is formed, during the emptying of the single stacker compartment, an auxiliary or intermediate stack from the arriving products, which following emptying of the stacker compartment is introduced therein.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE shows a schematic side view of an apparatus according to the invention for stacking printed products by means of at least one, but possibly two or more stacker units and arriving in an imbricated formation.

DETAILED DESCRIPTION OF THE PREFERRED EMBODIMENTS

Describing now the drawing, it is to be understood that only enough of the stacking apparatus has been shown as needed for those skilled in the art to readily understand the underlying principles and concepts of the present development, while simplifying the showing of the drawing. Although as a matter of convenience the invention will be described, by way of example and not limitation, with reference to an arrangement equipped with two stacker units, it is to be specifically understood that the teachings and underlying principles of the present invention are, as already previously indicated, applicable to a construction of stacking apparatus working with a single stacker unit, or for that matter working with more than two stacker units. Turning attention now specifically to the drawing, the infeed device for the printed products 1, in the present case, is constituted by a transport or conveyor device 2, as the same is known from the German Patent Publication No. 2,519,561 (and the corresponding U.S. Pat. No. 3,955,667). Therefore, as to a detailed description of the construction and the mode of operation of such transport or conveyor device 2 reference may be made to such just mentioned German printed patent publication and the cognate United States Patent. The transport or conveyor device 2 possesses at a not particularly illustrated traction element which is guided in a guide channel grippers or gripper elements 3 which are anchored in spaced relationship, and each of these grippers 3 fixedly retains a printed product 1. The grippers or gripper elements 3 are moved in the direction of the arrow A. The transport device 2 has arranged upstream thereof a non-illustrated infeeder which infeeds the printed products 1 to the transport device 2. This infeeder can be constituted, for instance, by a conveyor band or by the delivery unit of a rotary printing press.

The printed products 1 are conveyed in the form of an imbricated stream S by the transport or conveyor device 2. Within such imbricated stream S each printed product 1 may bear in an imbricated fashion upon the preceding product although they are preferably in spaced non-contacting relationship at their trailing edges as clearly shown in the drawing, so that the oppositely situated leading edges 1*a* of the printed products 1 are freely exposed and can be seized by the grippers 3.

Each gripper or gripper element 3 comprises an upper clamping tongue or jaw 3*a* and a lower clamping tongue or jaw 3*b* movable relative thereto and towards the upper clamping tongue or jaw 3*a* in order to substantially centrally seize one of the flat products 3 at its leading edge. The lower clamping tongue or jaw 3*b* is laterally pivotable away from the upper clamping tongue or jaw 3*a* in order to be able to immediately release the seized flat product 3 from such gripper or gripper element 3.

For opening the grippers or gripper elements 3 and in the exemplified situation where there are provided two successively arranged stacker units 8 and 9 there are used two successively arranged release devices 4 and 5 which are disposed behind one another at a predetermined spacing in the product conveying direction A. These release devices 4 and 5 are alternatingly switched-on and switched-off by means of a not further illustrated control device or control 6. When working with only two stacker units 8 and 9 it may be sufficient to only alternately switch on and off the first release device 4 and to continually keep the second release device 5 in its switched-on or activated state. Additionally, a signal transmitter 7 is connected with this control 6 and is arranged upstream of the release devices 4 and 5. This signal transmitter 7 counts in known manner the printed products 1 which move therepast.

Beneath each release device 4 and 5 and below the transport device 2 there is arranged a related one of the only purely schematically illustrated respective stacker units 8 and 9. These stacker units 8 and 9 are of conventional construction and can be constructed, for instance, in the manner disclosed in the already mentioned German Patent Publication No. 2,752,513 and the corresponding British Pat. No. 1,568,752. Each stacker unit 8 and 9 possesses a chute-shaped upwardly open stacker compartment 10 and 11, respectively, which is closed at the bottom by a stacker table 12 and 13, respectively. The stacker tables 12 and 13 can be raised and lowered in not here further illustrated manner in the direction of the double-headed arrow B and C, respectively. Arranged beneath the transport or conveyor device 2 and forwardly of the stacker units 8 and 9 are the supports 14 and 15 upon which come to bear the printed products 1 by means of their trailing edges 1*b*. As shown, these supports 14 and 15 are located above the inlet opening or upper edge of their related stacking compartment 10 and 11, respectively.

The previously described apparatus functions as follows:

At the point in time illustrated in the FIGURE the release device 4 is in its switched-on condition where it causes an opening of the grippers 3 moving therepast. The other release device 5 is switched-off or in the depicted case where only two stacker units 8 and 9 are used may even be left continuously switched-on or activated. Upon opening a gripper 3 the printed product seized by the same is released, as such has been illustrated for the printed product designated by reference character 1'. This released printed product 1' now drops over a certain path in a free-fall into the stacker compartment 10 of the stacker unit 8 located beneath the release device 4. The printed product 1'' located in the stacker compartment 10 now comes to bear upon the stacker table 12 or upon the stack 16 located upon such stacker table 12, as the case may be. The stacker table 12 is correspondingly lowered in accordance with the increasing height of the stack 16. It will also be understood that the printed product which has just been released by its associated gripper 3, here the depicted printed product 1', is, as explained, dropping in a state of free fall under the effect of the force of gravity, whereas the immediately trailing printed product 1 is still held by its associated gripper or gripper element 3 and is therefore still being dragged at its supported trailing end along the top surface of the support 14 at the conveying speed of the transport or conveyor device 2. This positively conveyed and dragged trailing printed product 1 therefore tends to move closer to the preceding free-falling printed product 1', so that the air or air cushion in the space between these two spaced printed products is compressed due to this aforedescribed action, and thus, tends to act like an air piston upon the preceding free-falling printed product 1' and thus exerts a downwardly acting force component upon such printed product 1' to advantageously promote its orderly deposition into the stacker compartment 10 of the stacker unit 8.

During the stacking of the printed products 1 in the stacker unit 8 the stacker compartment 11 of the other stacker unit 9 is emptied. At the point in time illustrated in the FIGURE the emptying of the stacker compartment 11 has already been completed and the stacker table 13 is illustrated in its upper terminal position where it is ready for the reception of products which are to be stacked.

After a predetermined number of printed products 1, which have been counted by the signal transmitter 7, have been stacked in the stacker compartment 10 of the first stacker unit 8, the control 6 switches-off the release device 4 and if not already switched-on switches-on the other release device 5. The grippers 3 now travel, together with the printed products 1 engaged thereby, past the first release device 4 and are first opened by the second release device 5. The printed products which are released by such opening of the grippers 3 drop into the stacker chute 11 of the second stacker unit 9 located below this second release device 5. The stack formation within the stacker compartment 11 of the second stacker unit 9 is accomplished in the manner described in conjunction with the first stacker unit 8. During such time as the printed products 1 are delivered to the second stacker unit 9 it is now possible to empty the stacker compartment 10 of the previously loaded first stacker unit 8.

After there has been stacked in the stacker compartment 11 of the second stacker unit 9 a predetermined number of printed products 1, there is accomplished a renewed switching of the release devices 4 and 5 by the control 6, at least the first release device 4 if, as explained, the second release device 5 may be left continuously switched-on when working with only two stacker units 8 and 9. Consequently, there is realized the result that again the first stacker unit 8 is loaded with printed products 1 which will be stacked in the already described manner in the stacker compartment 10.

The opening of the grippers or gripper elements 3 always is accomplished at the same location, namely at the site of the release device 4 or the release device 5. The printed products 1 are accordingly controlled and always released at the same location. Since the grippers 3 are arranged at a uniform spacing the printed products 1 are essentially released at the same timewise intervals, which facilitates an orderly stacking of the printed products 1. The printed products 1 are not introduced in an imbricated formation laterally to the stacker compartment 10 or 11, as the case may be, and propelled thereinto, as with the known solutions, rather are drawn by the transport device 2 over the stacker compartment 10 or 11, as the case may be, and then dropped. The products 1 move through the last path between the transport device 2 and the stacker compartment 10 or 11, as the case may be, in a free-fall in an essentially vertical direction. The printed products 1 do not impact at a great velocity against the wall of the stacker compartment 10, 11. Also, if the printed products come into contact, during their free-fall, with the stacker compartment wall, this occurs at a relatively low force, so that there is avoided damage to the printed products 1.

It should be understood that the previously described apparatus can be also differently constructed as to various parts thereof. In the description to follow there will be discussed a number of possible variations.

Thus, it is also possible to arrange in the conveying direction A of the transport device 2 more than two similar stacker units behind one another. In the described manner these stacker units are always furnished during a certain time span with printed products, whereupon the printed product infeed is interrupted for emptying the stacker chute, i.e. diverted to another stacker unit. Due to the provision of two and more stacker units it is possible to faultlessly process the continuously arriving printed products 1, without having to interrupt or delay the arriving printed product stream. Such continuous processing of the arriving imbricated stream S is however also possible if there is used only a single stacker unit which is provided with an auxiliary stacker device, upon which there are temporarily stacked the arriving printed products 1 during the emptying of the stacker compartment. The auxiliary or intermediate stack which is formed in this manner, following the successful emptying of the stacker compartment, is transferred to the latter. Such type of stacker unit has been described, for instance, in Swiss Pat. No. 566,928, to which reference may be readily had and the disclosure of which is incorporated herein by reference.

The possibility of selectively switching on and off different ones of successively arranged release devices associated with successively arranged stacker units for the purpose of accomplishing an orderly formation of predetermined product stacks in each stacker unit has been disclosed in the aforementioned British Pat. No. 1,568,752, published June 4, 1980, to which reference may likewise be readily had. When the inventive system is provided with only a single stacker unit and associated release device as can be the case as previously mentioned, then the aforedescribed product-counting signal transmitter 7, which is located at a predetermined distance from the single release device, such as the release device 4, and with a predetermined number of grippers 3 therebetween, causes the control 6 to operate this single release device 4 such that the desired number of product-carrying grippers 3 are opened to form a desired product stack 16 in the stacker compartment 10 of the related stacker unit 8. If there are, however, employed more than one stacker unit, such as the two stacker units 8 and 9, the product-counting signal transmitter 7 is still able to easily cause the control 6 to properly switch-on or activate one of the release devices and when necessary deactivate or switch-off the other release device at the appropriate times without any problem as will be readily understood by those skilled in this art.

This will be readily evident from the fact that the signal transmitter 7 is spaced at a fixed distance from each of the release devices 4 and 5 and the two release devices 4 and 5 are equally spaced at a fixed distance from one another. Consequently, between the signal transmitter 7 and the first release device 4 there are always present a predetermined number of grippers 3, and a further predetermined number of grippers 3 is always present between the signal transmitter 7 and the second release device 5, while a still further predetermined number of grippers 3 is present at all times between the two successively arranged release devices 4 and 5. Therefore by virtue of the product-counting operation performed by the signal transmitter 7 the control 6 can readily determine which products are to be deposited in which of the two stacker units 8 and 9 and thus the two release devices 4 and 5 are appropriately operated at the correct moment of time so that the contemplated product stacks are formed in each stacker unit 8 and 9.

As a simple example assume that the distance between the product-counting signal transmitter 7 and the first release device 4 amounts to the spacing between 10 grippers 3 and the distance from such signal transmitter 7 to the second release device 5 amounts to the spacing between 15 grippers. As a further simplification assume that there are only used two stacker units, such as the stacker units 8 and 9 shown in the drawing which must be supplied with products. With such system design it is possible to even further simplify the control operation for the release devices 4 and 5 by simply leaving the second release device 5 always activated so that it opens every gripper 3 moving therepast which has not previously been opened. Further assume that in each stacker unit 8 and 9 there is to be formed a respective stack each composed of 20 products 1. Thus at the start of the stacking operation after the product-counting signal transmitter 7 has counted 29 products moving therepast the 20th product of the first twenty-copy stack to be formed will be located with its related gripper at the position of the first release device 4 which now must be deactivated by the control 7 with a slight time delay to take into account the inertia of the system but sufficiently rapidly such that the next following product-carrying gripper 3 arrives at an already deactivated release device 4. With the described system design it will be further readily apparent to those skilled in the art that the product-counting signal transmitter 7 would have to have counted 54 product-carrying grippers 3 moving therepast for the 20th product of the second stack which is to be formed in the second stacker unit 9 to be located with its gripper at the second release device 5 associated with such second stacker unit 9. However, to take into account the products located at that time forwardly of the second release device 5 and up to the location of the first release device 4 and to satisfy the requirement to already begin depositing these products in the first stacker unit 8, it will be necessary for the signal transmitter 7 to already cause the control 6 to again activate the first release device 4 beforehand, in the illustrative example after it has counted the movement of the 48th product-carrying gripper therepast. Consequently, at the time that the 54th product-carrying gripper is located at the release device 5 for depositing the 20th product of the second stack in the second stacker unit 9, the release device 4 will have been in operation sufficiently beforehand to ensure that there are no product-carrying grippers in the path between the two stacker units 8 and 9 at such time as the first stacker unit 8 is completing the formation of the next twenty-copy stack. The described operation obviously repeats so that the described twenty-copy stacks can be alternately formed in the two stacker units 8 and 9. It is, of course, possible to periodically switch on and off the second release device 5 at the appropriate times in consideration of the product-counting operation performed by the signal transmitter 7. Also, the aforedescribed principles can be obviously extended to a system design working with more than two stacker units.

Under circumstances it can be necessary, following the release of the printed products 1, to brake their forward movement in the conveying direction A of the transport device 2. For this purpose there can be provided at the region of the release devices 4 and 5 suitable means which can be brought to act in synchronism with the release devices 4 and 5 upon the products 1. Thus, for instance, there can be provided stops which can be introduced into the conveying path of the printed products 1. Such type of solution has been more specifically described, for instance, in my commonly assigned U.S. Pat. No. 4,445,681, granted May 1, 1984. Additionally, it is also conceivable to provide a retarding device which briefly acts upon the released printed product and brakes the same.

Instead of the transport device 2 there can also be used other conveyor devices of suitable construction, such as for instance the conveyor device described in the German Patent Publication No. 3,102,242 (and the corresponding British Patent Publication No. 2,068,892).

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for stacking relatively stiff flat products, especially relatively stiff flat products arriving in an imbricated stream of relatively stiff flat products, comprising:

a stacker device;

said stacker device possessing at least one upwardly open and periodically emptiable stacker compartment for receiving the relatively stiff flat products and forming stacks thereof;

a conveyor device for conveying the relatively stiff flat products in a predetermined conveying direction towards said at least one stacker compartment;

said conveyor device including a multitude of individually operable and mutually spaced gripper elements and extending above said at least one stacker compartment;

each said gripper element gripping an individual one of said relatively stiff flat products at a leading edge thereof;

said at least one stacker compartment defining an inlet opening through which said printed products are received;

at least one support arranged below said conveyor device forwardly of said stacker device as seen in said predetermined conveying direction and supporting substantially only trailing edges of the relatively stiff flat products in essentially continuous contact and which relatively stiff flat products are gripped by said gripper elements of said conveyor device in a spaced non-contacting relationship and inclined with respect to said predetermined conveying direction;

said at least one support being arranged between said conveyor device and said inlet opening of said at least one stacker compartment forwardly of the latter as seen in said predetermined conveying direction;

said at least one support extending in said predetermined conveying direction towards said at least one stacker compartment and terminating closely adjacent thereto but above said inlet opening of said at least one stacker compartment;

control means for releasing the relatively stiff flat products from said gripper elements at a location above said at least one stacker compartment; and said mutually spaced gripper elements gripping said leading edges of said relatively stiff flat products such that there is formed a space between each two successively gripped flat products and in which space there is formed an air cushion which is compressed upon release of one of the relatively stiff flat products for movement in a free fall over the stacker compartment due to the action of the next following still gripped relatively stiff flat product which is moving at a greater speed than the free-falling one released product such as to reduce the spacing between these two relatively stiff flat products, whereby said free-falling one released relatively stiff flat product is downwardly propelled by the action of the air cushion into the stacker compartment.

2. The apparatus as defined in claim 1, wherein:

said control means include at least one release device arranged above said at least one stacker compartment.

3. The apparatus as defined in claim 1, wherein:

each said gripper element comprises an upper clamping tongue and a lower clamping tongue movable relative thereto;

said lower clamping tongue being movable towards said upper clamping tongue in order to substantially centrally seize the relatively stiff flat product at said leading edge thereof; and said lower clamping tongue being laterally pivotable away from said upper clamping tongue in order to immediately release the relatively stiff flat product from said gripper element.

4. The apparatus as defined in claim 1, wherein:

said at least one support at all times supports only said trailing edges of said flat products.

5. The apparatus as defined in claim 1, wherein:

said stacker device comprises at least two said stacker compartments which are series arranged with respect to said predetermined conveying direction;

said control means comprising at least two said release devices;

each one of said at least two release devices being arranged above a related one of said at least two stacker compartments; and at least one of said release devices being alternately activatable for a predetermined time span in order to alternately cause selective release of the relatively stiff flat products above the one or the other of said at least two stacker compartments.

* * * * *